000046 1203 -00 10-07-80 28330 09-04-80 043503 78147.0 04227164 3543

United States Patent [19]

Kitahara

[11] 4,227,164

[45] Oct. 7, 1980

[54] ELECTROMAGNETIC ROTATING APPARATUS

[75] Inventor: Haruo Kitahara, Ījima, Japan

[73] Assignee: Shinano Tokki Corporation, Japan

[21] Appl. No.: 908,250

[22] Filed: May 22, 1978

[30] Foreign Application Priority Data

Aug. 20, 1977 [JP] Japan ..... 52/99725

[51] Int. Cl.² ..... H01F 7/00

[52] U.S. Cl. ..... 335/230; 335/272; 310/36

[58] Field of Search ..... 335/229, 230, 272, 276; 310/36-39, 194, 269

[56] References Cited

U.S. PATENT DOCUMENTS 3,158,796 11/1964 Musgrave ..... 335/272 X 3,543,067 11/1970 Tharp ..... 310/194

*Primary Examiner*—Donovan F. Duggan

*Attorney, Agent, or Firm*—Woodling, Krost & Rust

[57] ABSTRACT

This invention relates to a rotary solenoid or similar electromagnetic rotating apparatus that is capable of smoothly rotating through an angular range of approximately 180 degrees, in both directions, without employing a return spring or other like means.

4 Claims, 9 Drawing Figures

FIG. 7
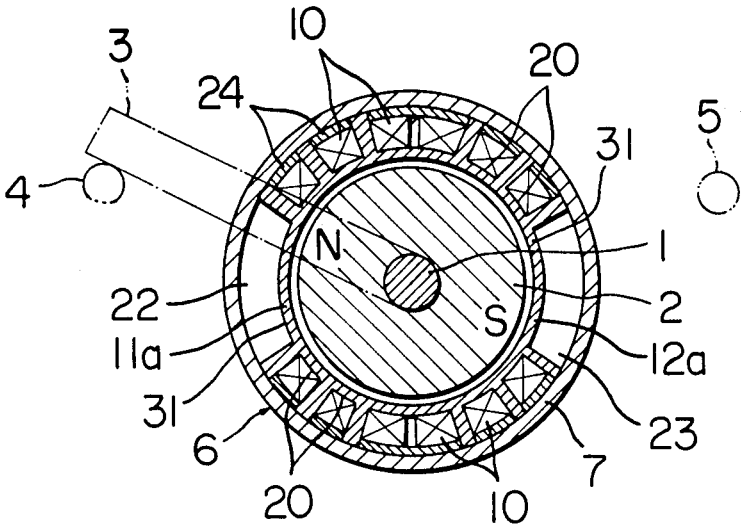
FIG. 8
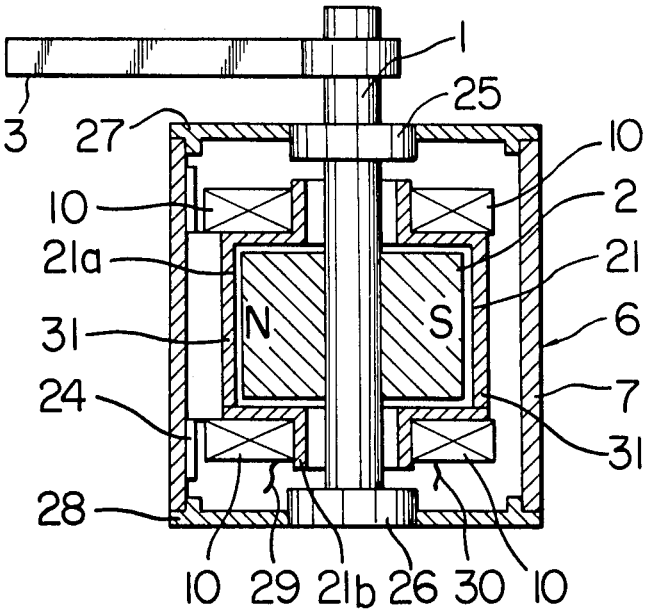
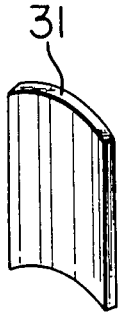
FIG. 9

ELECTROMAGNETIC ROTATING APPARATUS

Conventional rotary solenoids are broadly classified into two categories; one that converts axial motion produced by electromagnetic attraction into rotary motion by use of a mechanical transforming mechanism utilizing an inclined groove and a ball, and the other that directly rotates a rotor of soft magnetic material by means of an electromagnet. Regardless of this difference, however, the conventional rotary solenoids are attracted or rotate only in a direction in which magnetic reluctance reduces, because their moving members are made of soft magnetic material. Therefore, they require a return spring or other similar means to bring them back to the original position when not in operation. It is of course possible to constitute a bi-directionally rotating system by combining two solenoids of uni-directional torque type, disposed opposite to each other. In principle, however, this system does not differ from the uni-directional solenoid. In addition, the angular range of rotation of the conventional rotary solenoids has been limited to approximately 90 degrees because of their design concepts. Further, they have required continued energizing or provision of a lock mechanism to maintain the operating position.

The object of this invention is to provide a rotary solenoid or similar electromagnetic rotating apparatus that is rotatable in both directions through an angular range of approximately 180 degrees and has a high holding torque.

To achieve the afore-said object, electromagnetic rotating apparatus according to this invention comprises a rotating shaft, a permanent magnet fixed to said rotating shaft and magnetized to produce magnetic flux perpendicular to the axis of said rotating shaft, a non-magnetic insulating core surrounding said permanent magnet, a fixed solenoid coil wound around said core so as to surround said permanent magnet, a holding magnetic segment fixed to said non-magnetic core so as to close the open end of said fixed coil, an energizing circuit to selectively energize said fixed coil positively or inversely, and first and second stoppers to limit the rotation of said permanent magnet within an angular range of less than 180 degrees and make maximum the magnetic flux interlinking with said fixed coil.

The rotating shaft and permanent magnet of this invention rotate from the first stop position to the second stop position when a positive current is fed to the fixed coil, and from the second stop position to the first stop position when energized inversely, and perform tasks corresponding to the angle of rotation covered. This eliminates the need of a return spring, and provides the same torque in both directions without disposing two rotary solenoids opposite to each other as has been done heretofore. Because they can rotate through an angle close to 180 degrees, the rotary solenoid according to this invention can be used for wider applications. Further, winding a conductor around the non-magnetic core into a solenoid-like shape offers a fixed coil of simple structure with ease. Provision of the magnetic segment of iron, silicon steel or the like at the open end of the fixed coil increases a force to hold the permanent magnet in the first or second stop position. This permits stably holding the permanent magnet rotated to the stop position, and decreasing or dispensing with holding energizing current.

The principle and embodiments of the rotary solenoid according to this invention will be described hereunder by reference to the accompanying drawings.

BRIEF DESCRIPTION OF THE DRAWINGS

FIG. 7 is a cross-sectional view taken along the line VII—VII of FIG. 6.

FIG. 8 is a cross-sectional view taken along the line VIII—VIII of FIG. 5.

FIG. 9 depicts magnetic segments attached to the core.

In FIGS. 1 through 4 the principle of the rotary solenoid according to this invention, a rotating shaft 1 is fixed with a permanent magnet 2 having north and south poles perpendicular to the axis of said rotating shaft, and an arm-like position-limiting engaging member 3. Supported by bearings provided in such stationary section as a bracket, the rotating shaft 1 rotates freely with the permanent magnet 2 and engaging member 3. Though the permanent magnet 2 in FIG. 1 is bar-shaped, it may be a cylindrical one having north and south poles thereon, too, as shown in an embodiment to be described later. The engaging member 3 also need not be arm-shaped, but of any shape so far as it comes in contact with first and second stoppers 4 and 5. The first and second stoppers 4 and 5 may be provided on the stationary section of the rotary solenoid, or on any equipment in the vicinity thereof.

Figure 1:
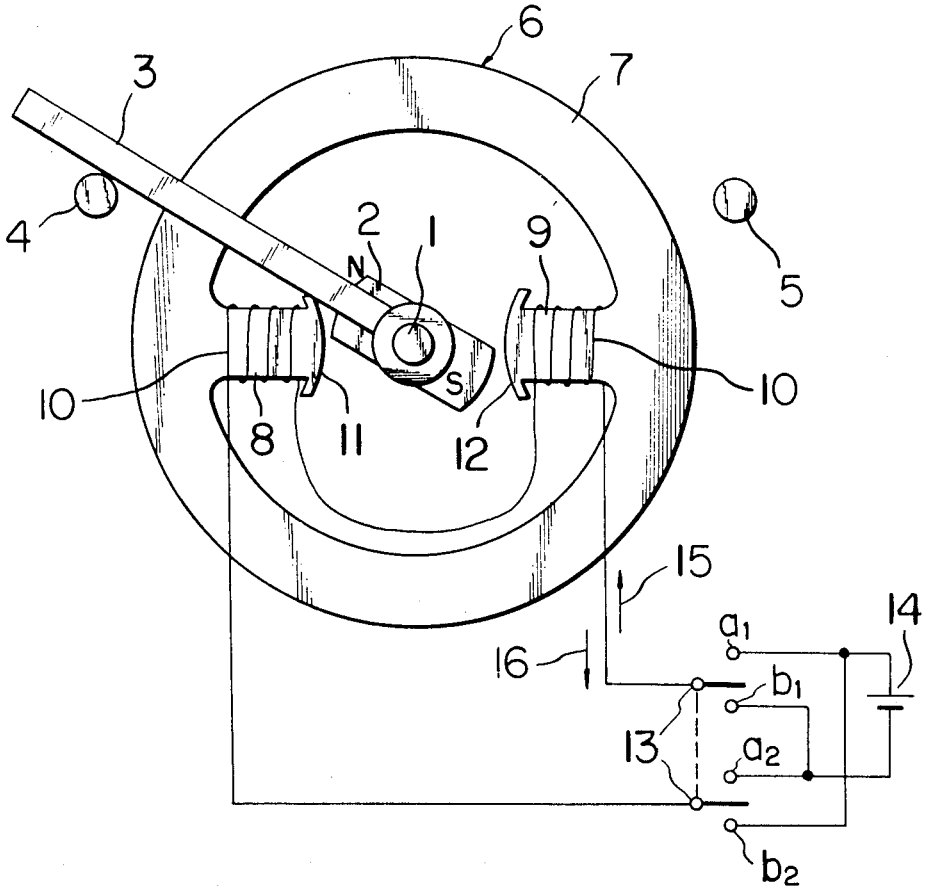
FIG. 1 is a plan view showing the operating principle of a rotary solenoid according to this invention.
Figure 2:
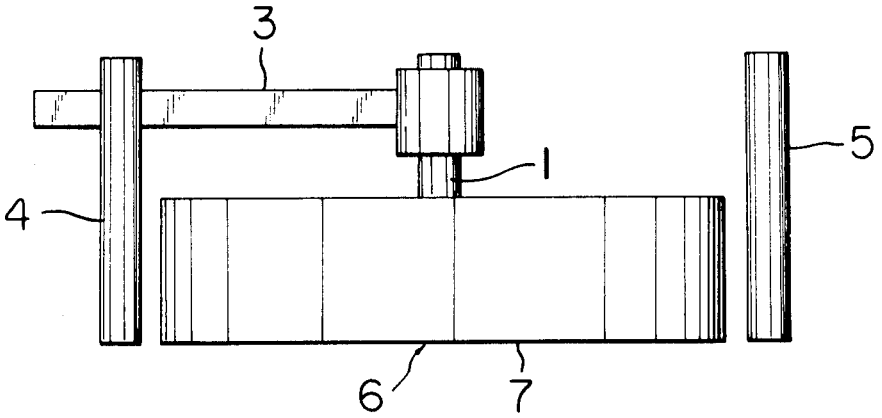
FIG. 2 is a front view similar to FIG. 1.

Reference numeral 6 designates a member of soft magnetic material that constitutes a magnetic circuit, comprising a yoke section 7 of cylindrical iron and a pair of projected core sections 8 and 9. To facilitate understanding, this figure shows a fixed coil 10 wound around the core sections 8 and 9. As evident from the embodiment described later, this invention actually eliminates the core sections 8 and 9 to obtain a simplified construction. Instead, the coil 10 is wound around the non-magnetic core of synthetic resin like a solenoid. On energizing the coil 10 in FIG. 1, north and south poles are established at the core sections 8 and 9. Even on the coreless solenoid coil according to this invention, apparent north and south poles are established at both ends.

As evident from FIG. 1, the permanent magnet 2 is disposed between a first magnetic pole 11 formed at the tip of one core section 8 and a second magnetic pole 12 at the tip of the other core section 9. In other words, the fixed coil 10 is disposed so as to interlink with the magnetic flux produced by the permanent magnet 2.

In this invention, the position of the first and second stoppers 4 and 5 is very important. The first and second stoppers 4 and 5 are disposed within an angular range not including the center lines of the first and second magnetic poles 11 and 12, so that first and second stop positions lie therebetween. Therefore, the angular space between the first and second stop positions respectively defined by the first and second stoppers 4 and 5 must be less than 180 degrees. Further, the first and second stop positions should not coincide with the first and second magnetic poles 11 and 12, respectively. Otherwise, it becomes impossible to start the permanent magnet.

A polarity changing switch 13 and a direct-current power supply 14 are provided to constitute an energizing circuit to selectively energize the fixed coil in positive and negative directions.

When the polarity changing switch 13 of the above-described apparatus is in neutral position as shown in FIG. 1, and the fixed coil 10 is not energized, north and south poles do not develop in the first and second core sections 8 and 9. Accordingly, the permanent magnet 2 is held in a position shown in FIG. 1 by a relatively small holding force, wherein said magnet 2 lies close to the core sections 8 and 9 of soft magnetic material. The same is applicable to the embodiment described later, which is devoid of the core sections 8 and 9. Of course, the permanent magnet 2 may be kept in the stop position more securely by an attracting force between a south pole at the first magnetic pole 11 and the north pole of the permanent magnet 2 and an attracting force between a north pole at the second magnetic pole 12 and the south pole of the permanent magnet 2 by connecting the switch 13 with contacts $b_1$ and $b_2$, feeding an inversed current, indicated by an arrow 16, from the direct-current power supply to the fixed coil, and thereby establishing the south pole at the first magnetic pole 11 and the north pole at the second magnetic pole 12.

Figure 3:
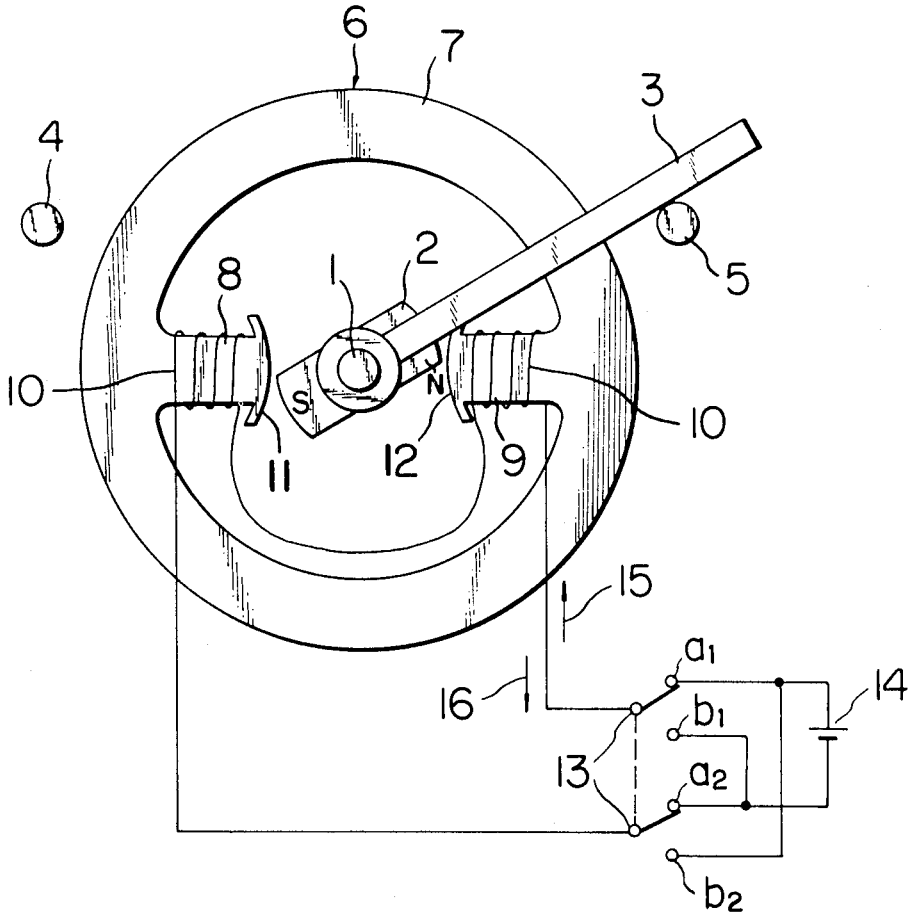
FIG. 3 is a plan view in which a permanent magnet has been rotated from the position of FIG. 1.
Figure 4:
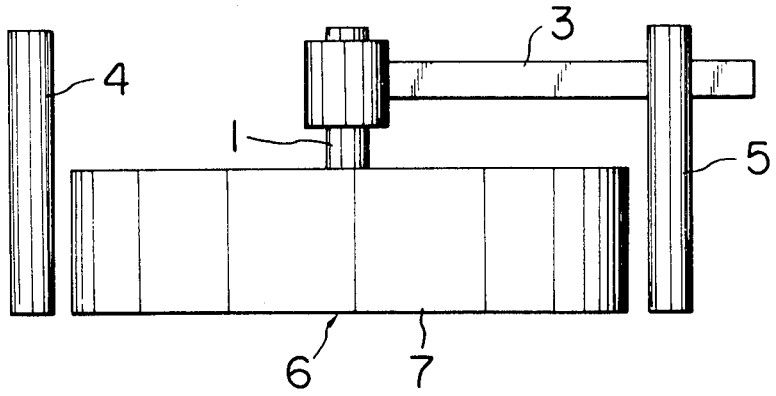
FIG. 4 is a front view similar to FIG. 3.

When the switch 13 is connected with contacts $a_1$ and $a_2$ from the state shown in FIG. 1, a positive current indicated by an arrow 15 flows into the coil 10, whereupon the first magnetic pole 11 becomes a north pole and the second magnetic pole 12 a south pole, and the permanent magnet 2 lies somewhat aslant therebetween. Then, repulsive forces develop between the north pole at the first magnetic pole 11 and the north pole of the permanent magnet 2 and between the south pole at the second magnetic pole 12 and the south pole of the permanent magnet 2, whereupon the permanent magnet 2 starts to rotate clockwise in FIG. 1. In other words, torque develops in the coil 10 as the magnetic flux passing through the permanent magnet 2 and magnetic circuit member 6 interlinks with the energized coil 10. Thereupon, the permanent magnet 2 rotates as the coil 10 is fixed. Then permanent magnet 2 rotates to a vertical position in FIG. 1, where the torque becomes maximum, thence to the second stop position as shown in FIG. 3. In that position, the engaging member 3 contacts the second stopper 5 to stop the motion of the permanent magnet 2. While the coil 10 remains energized in the state of FIG. 3, north and south poles are established at the first and second magnetic poles 11 and 12, respectively, which develop attracting forces between them and the south and north poles of the permanent magnet 2. These attracting forces keep the permanent magnet 2 in that position. Even if the coil 10 has been deenergized before the engaging member 3 reaches the second stopper 5, the permanent magnet 2 continues to rotate, by force of inertia, to the second stop position defined by the second stopper 5, conditional on that the north pole of the permanent magnet 2 has passed the vertical center line in FIG. 1. Without the second stopper 5, the south pole established at the second magnetic pole 12 would perfectly oppose the north pole of the permanent magnet 2. Then, even if an inversed current were fed to the coil 10, it would be impossible to impart a counterclockwise or clockwise torque to the permanent magnet 2.

The permanent magnet 2 is returned from the position of FIG. 3 to that of FIG. 1 by connecting the switch 13 with the contacts $b_1$ and $b_2$ from the state of FIG. 3. Thereupon, an inversed current, indicated by an arrow 16, flows to the coil 10, and the permanent magnet 2 rotates to the first stop position shown in FIG. 1, reversing the order followed when moving from the position of FIG. 1 to that of FIG. 3. If the first and second stoppers 4 and 5 are disposed symmetrically, the torque of reversed rotation can be made equal to that of positive rotation.

Now a rotary solenoid embodying this invention will be described by reference to FIGS. 5 through 8. Items designated by reference numerals 1 through 7, 10, 15 and 16 in FIGS. 5 through 8 will not be explained, since their makeup and function are the same as those of the items denoted by the same reference numerals in FIGS. 1 through 4.

Figure 5:
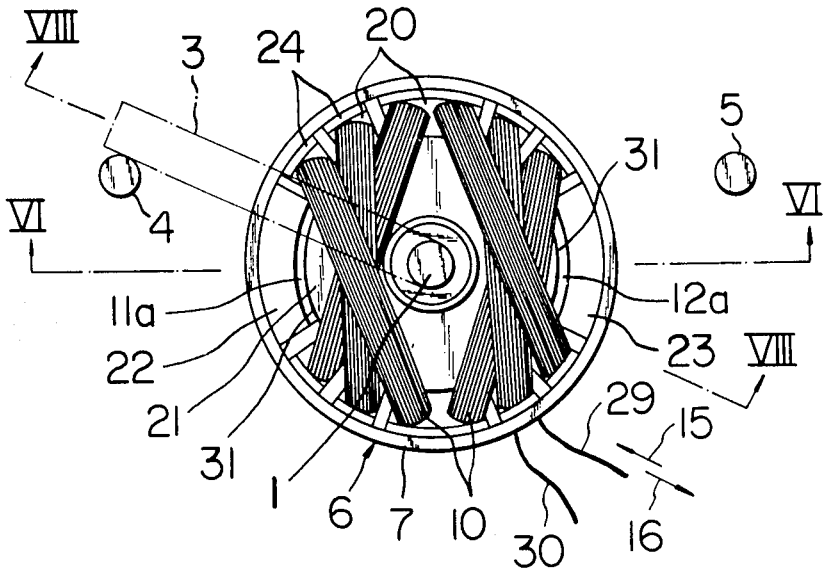
FIG. 5 is a plan view showing the inside of a rotary solenoid embodying this invention, with a bracket thereof taken away.
Figure 6:
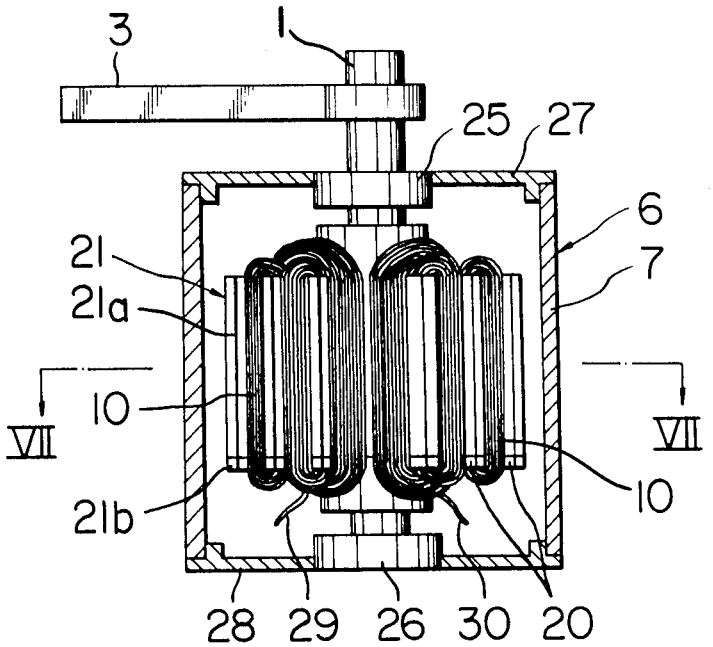
FIG. 6 is a front view, with a part thereof cut open along the line VI—VI of FIG. 5.

In a rotary solenoid shown in FIGS. 5 through 8, a non-magnetic core of synthetic resin 21, having a plurality of slots 20, is used to facilitate winding a coil 10 in a solenoid-like shape. As evident from FIGS. 5 through 7, the non-magnetic core 21 has ten slots 20, which extend in the direction of the axis of a rotating shaft 1 as shown in FIG. 6. To attain as much resemblance as possible to the solenoid, the coil 10 is uniformly wound around the slots 20 of the core 21. As shown in FIGS. 5 and 7, the coil 10 is not wound around the left and right ends of the core 21, thus leaving a left open solenoid end 22 and a right open solenoid end 23. As seen in FIG. 5, the coil 10 is wound clear of a rotating shaft 1. The diameter of the solenoid reduces progressing apart from the shaft 1, following the cross-sectional contour of the cylindrical core 21 extending axially. As in an ordinary solenoid, a uniform magnetic field can be established inside the solenoid-like coil 10. The non-magnetic core 21 comprises cores **21*a* and 21*b* that are axially bisectable. The cores 21*a* and 21*b* are put together outside a permanent magnet 2 attached to the rotating shaft 1 to make up the non-magnetic core 21, then the coil 10** is formed by winding a conductor therearound.

Before or after winding the conductor around the core 21, magnetic segments 31 of iron or silicon steel, shown in FIG. 9, are attached to the periphery of the core 21. As seen in FIGS. 5 and 7, the magnetic segments 31 are provided in such positions to close the left and right open solenoid ends 22 and 23.

The core 21 wound with the coil 10 is press-fitted in the cylindrical soft magnetic member constituting magnetic circuit 6 of soft iron that functions both as a case and a yoke, and fixed thereto with a bonding agent. To assure perfect insulation between the coil 10 and the magnetic circuit member 6, an insulating synthetic resin sheet 24 is inserted therebetween.

A pair of bearings 25 and 26 to rotatably support the rotating shaft 1 are fitted in a pair of brackets 27 and 28 which are in turn cocentrically fitted to the yoke section 7 or the cylindrical magnetic circuit member 6.

The permanent magnet 2 attached to the rotating shaft 1 is cylindrical in shape, and has north and south poles at two opposite external ends of the radial cross-section thereof, as shown in FIGS. 7 and 8. When the rotary solenoid is in use, the permanent magnet 2 is prevented from perfectly coinciding with the direction of magnetic flux developed on energizing the solenoid coil 10 by the first and second stoppers 4 and 5. Instead, the north and south poles are disposed aslant as exemplified in FIG. 7.

When a pair of coil ends 29 and 30 are connected to a selective bi-directional energizing circuit and a positive current is fed to the coil 10 as indicated by an arrow 15 in FIG. 5, a substantially uniform magnetic field is established in the coil 10. As the coil 10 of this embodiment is wound around the non-magnetic core 21, the magnetic poles 11 and 12 at the core sections 8 and 9 do not develop, unlike the case previously described by reference to the principle drawings. Instead, the paired open solenoid ends 22 and 23 become apparent magnetic poles. In FIGS. 5 and 7, reference character 11*a* designates a first apparent magnetic pole on one magnetic segment 31, and 12*a* a second apparent magnetic pole on the other magnetic segment 31. On feeding a positive current to the coil 10, the first apparent magnetic pole 11*a* becomes a north pole, and the second apparent magnetic pole 12*a* a south pole, whereupon the permanent magnet 2 lies aslant in the horizontal magnetic flux extending from the first apparent magnetic pole 11*a* to the second pole 12*a* in FIG. 7. Then a torque arises, and the permanent magnet 2 rotates clockwise in FIGS. 5 and 7. This clockwise rotation terminates in the second stop position where the engaging member 3 contacts the second stopper provided on nearby equipment. When inversely energized while the permanent magnet 2 stays in the second stop position, the first apparent magnetic pole 11*a* becomes a south pole and the second apparent magnetic pole 12*a* a north pole, whereby the permanent magnet 2 rotates counterclockwise until it returns to the first stop position.

In this embodiment, the permanent magnet 2 constitutes a rotor, and the magnetic segments 31 are disposed in the vicinity of the first and second stop positions thereof. Accordingly, a holding force resulting from the attraction between the permanent magnet 2 and the magnetic segments 31 does not permit the permanent magnet 2 to readily move from the first or second stop position, even if deenergized after the permanent magnet 2 has rotated thereto.

As evident from the above, this rotary solenoid can generate bi-directional driving forces by simply changing the direction of current supplied.

Also, the angular range of rotation can be extended close to 180 degrees, or any angular range can be selected within the limit of 180 degrees.

The use of the non-magnetic core 21 facilitates the winding of the coil 10 therearound, formation of a good solenoid enclosing the permanent magnet 2, disposing the coil 10 and the permanent magnet 2 in good relationship, and obtaining the desired torque.

Because the magnetic segments 31 are provided in the vicinity of the stop positions of the permanent magnet 2, the permanent magnet 2 is held there with greater force. Therefore, the permanent magnet 2 is kept in the stop position, without requiring energizing for holding.

It is also possible to increase the holding force even when energizing for holding is done after the permanent magnet has stopped rotation. When not so great holding force is required, the holding energizing current can be reduced.

Further, the use of the magnetic circuit member 6 not only as a yoke but also as a case in which the core 21 is press-fitted is conducive to simplifying the entire structure.

It will be evident from the foregoing that this invention is not limited to the embodiments and modifications thereof described herein, but susceptible of many other modifications and variations. For example, the task dependent on the rotation of the permanent magnet 2 may be accomplished either by the engaging member 3, the rotating shaft 1, the permanent magnet 2 itself, or by attaching a power transmiting member to the shaft 1. In the embodiment, energizing is continued until the permanent magnet 2 has rotated to the first or second stop position. But it may be discontinued halfway so that the permanent magnet 2 continues to rotate by force of inertia. Or a holding current may be fed to the coil 10 only when the engaging member 3 comes in contact with the stopper 4 or 5, in order to prevent undesirable vibration. The magnetic segments 31 may be shaped like a channel and fitted to the core 21. Also, the permanent magnet 2 may be bar- or plate-shaped.

What is claimed is:

1. Electromagnetic rotating apparatus comprising a rotating shaft, a bi-polar permanent magnet fixed to said rotating shaft and radially magnetized, a non-magnetic insulating fixed core having a plurality of axially extending slots formed in the outer peripheral surface of a hollow cylinder which embraces rotating side and peripheral surfaces of said permanent magnet, a fixed solenoid coil wound around said core so as to surround said permanent magnet, a holding soft magnetic segment fixed to both opposite end portions of said outer peripheral surface of said fixed coil so as to close the open ends of said fixed coil, an energizing circuit to selectively energize said fixed coil positively or inversely, and first and second stoppers to limit the rotating of said permanent magnet within an angular range of less than 180 degrees and make maximum the magnetic flux interlinking with said fixed coil.

2. Electromagnetic rotating apparatus comprising a rotating shaft, a bi-polar magnet fixed to said rotating shaft, a non-magnetic core, said core surrounding said bi-polar magnet, means for rotatably connecting said rotating shaft to said core, a solenoid coil, said solenoid coil wound around said core and surrounding said bi-polar magnet, means for preventing rotation of said shaft over 180° and for preventing registry of the magnetic poles of said bi-polar magnet to those of said solenoid, and an energizing circuit to selectively energize said fixed coil positively or inversely.

3. The structure of claim 2 characterized by the addition of two end magnetic segments, said magnetic segments being of soft magnetic material, means for attaching said magnetic segments to said core with one magnetic segment being located at one end of said solenoid coil and the other magnetic segment being located at the other end of said solenoid coil.

4. The structure of claim 3 characterized in that said solenoid coil has overlapping windings.

* * * * *